US006116323A

United States Patent [19]

Huang

[11] Patent Number: 6,116,323

[45] Date of Patent: Sep. 12, 2000

[54] DUAL FUNCTION DRAGGING DEVICE FOR CURTAIN

[76] Inventor: Shien-Te Huang, P.O. Box 82-144, Taipei, Taiwan

[21] Appl. No.: 09/332,043

[22] Filed: Jun. 14, 1999

[51] Int. Cl.[7] ..... E06B 9/308

[52] U.S. Cl. ..... 160/170 R; 160/168.1 R; 160/176.1 R

[58] Field of Search ..... 160/168.1 R, 170 R, 160/171 R, 175 R, 178.1 R, 173 R, 178.3 R; 474/142

[56] References Cited

U.S. PATENT DOCUMENTS

| | | | |
|---|---|---|---|
| 2,276,425 | 3/1942 | Slattery | 160/176.1 R |
| 2,560,840 | 7/1951 | Barnes, Sr. | 160/175 R |
| 2,663,368 | 12/1953 | Walker | 160/177 R |
| 4,334,572 | 6/1982 | Frei | 160/170 R |
| 4,522,244 | 6/1985 | Brolin | 160/170 R |
| 4,706,726 | 11/1987 | Nortoft | 160/168.1 P |
| 5,123,472 | 6/1992 | Nagashima et al. | 160/170 R |
| 5,133,399 | 7/1992 | Hiller et al. | 160/171 R |

FOREIGN PATENT DOCUMENTS

| | | | |
|---|---|---|---|
| 509 | 4/1812 | France | 160/171 |
| 796936 | 6/1958 | United Kingdom | 160/170 |

*Primary Examiner*—Blair M. Johnson
*Attorney, Agent, or Firm*—A & J

[57] ABSTRACT

A dual function dragging device for curtain is characterized in that a dragging device is driven by a driving means to has clockwise or counterclockwise rotation. The dragging device comprises a shaft and a clutch means wherein the clutch means performs an initial dragging to the slats, thus providing dual function for opening/closing the curtain and changing the angle of the drapes.

1 Claim, 11 Drawing Sheets

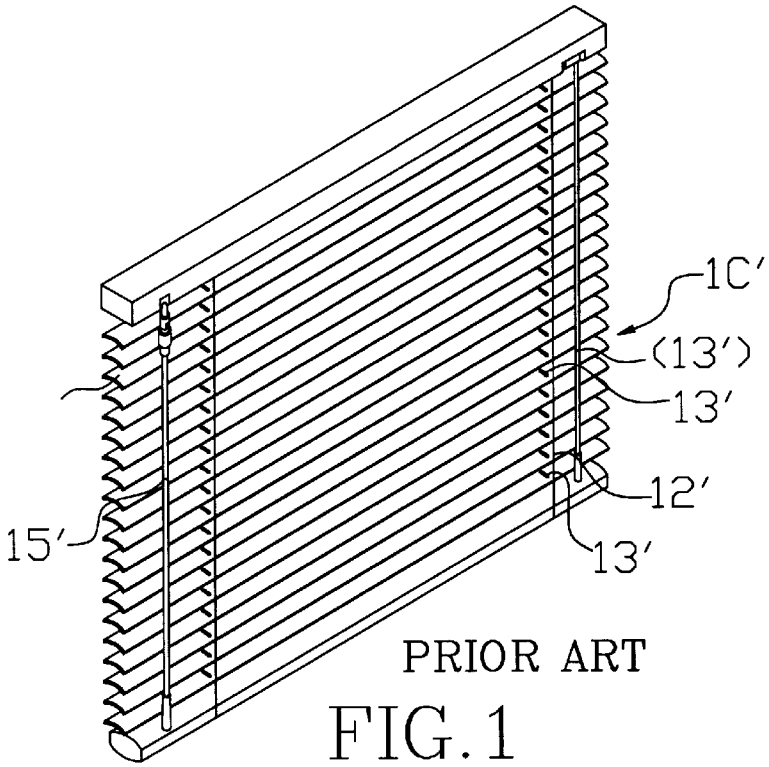
PRIOR ART
FIG. 1
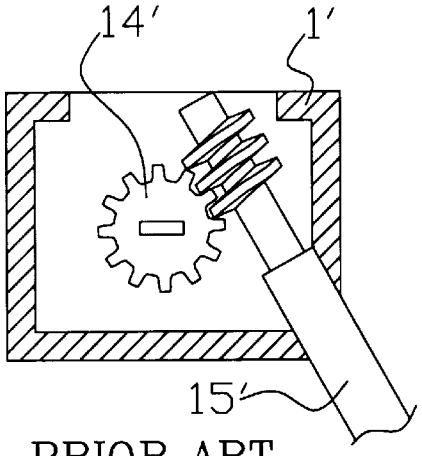
PRIOR ART
FIG. 1−1
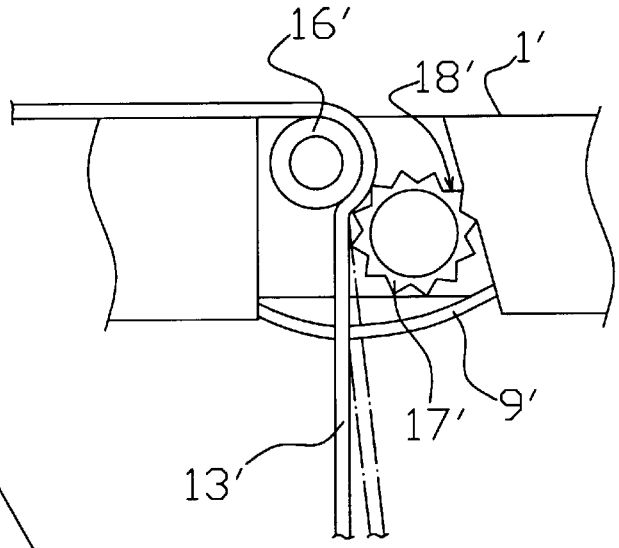
PRIOR ART
FIG. 1−2

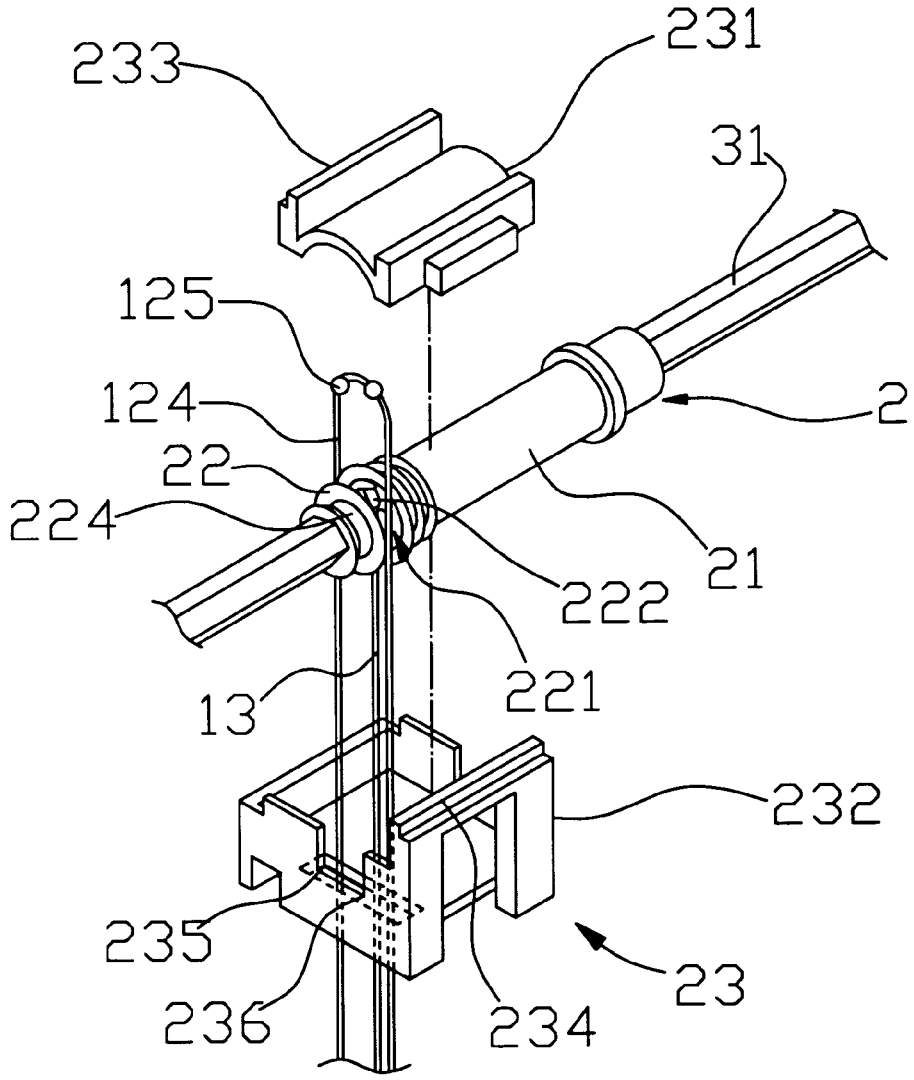
FIG. 4−1

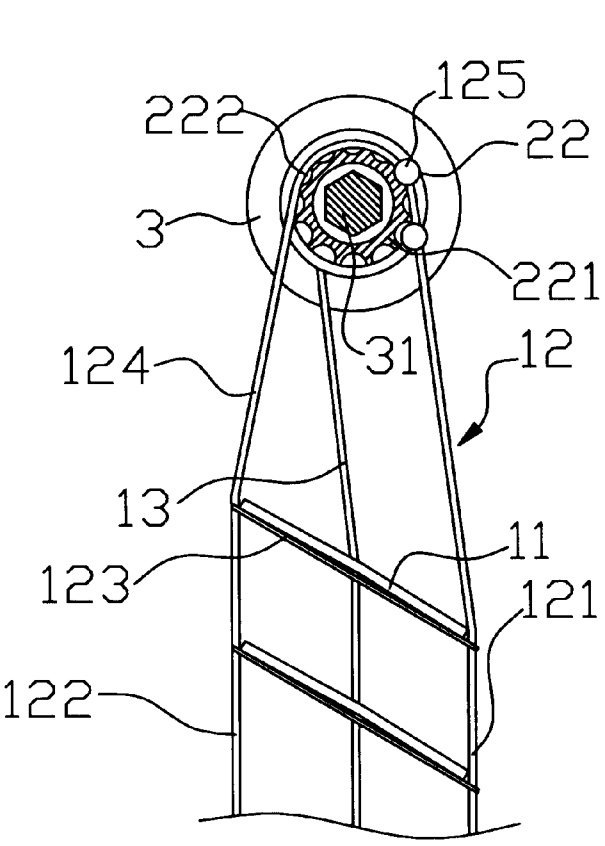
FIG. 5—2
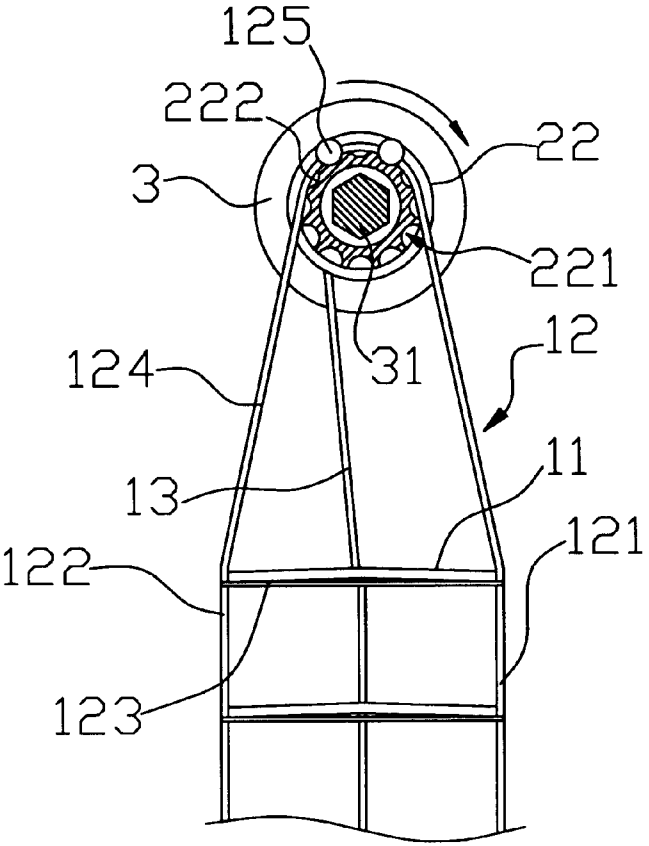
FIG. 5—1

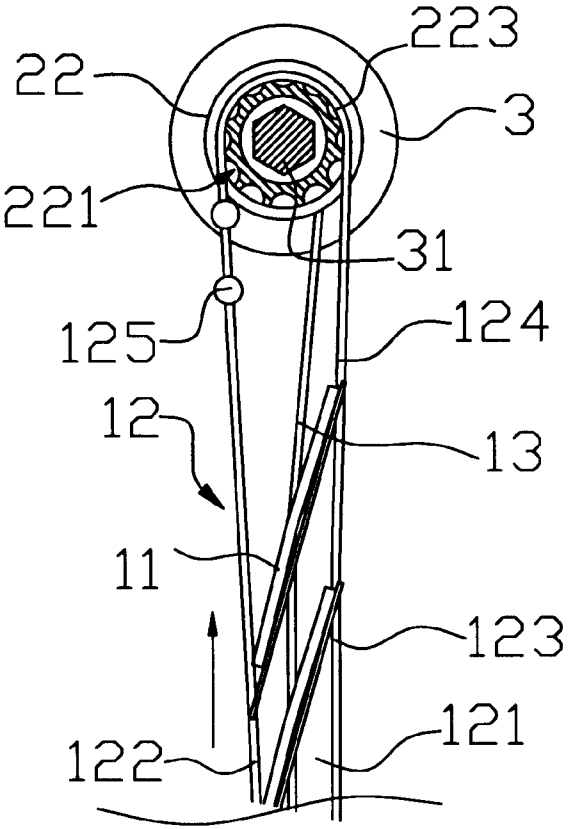
FIG. 5—4
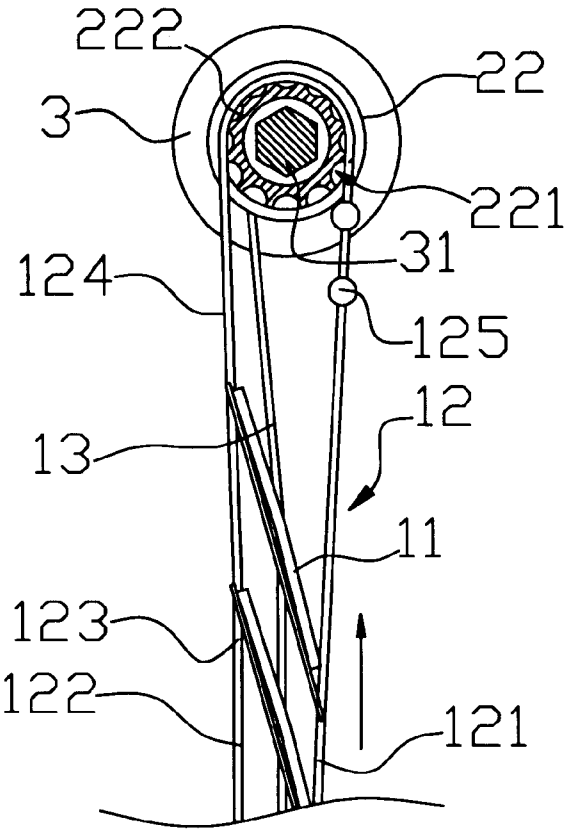
FIG. 5—3

DUAL FUNCTION DRAGGING DEVICE FOR CURTAIN

FIELD OF THE INVENTION

The present invention relates to a dual function dragging device for curtain, which provides dual function by a single dragging device, thus simplifying the operation and enhancing the appearance of the curtain.

BACKGROUND OF THE INVENTION

The household curtain is used to block light and generally has attractive color for decoration. As shown in FIGS. 1, 1-1, 1-2, the conventional curtain 10' comprises a plurality of slats 11' strung by ladder rope 12 and a dragging cord 13' to control the open or close of the curtain 10'. As shown in FIG. 1-1, the rope 12' is arranged within a frame 1' and coaxial with a warm 14', thus changing the angle of the slats. As shown in FIG. 1-2, the dragging cord 13' emerges from the frame at a proper outlet and a locking means comprising a stationary wheel 10' and a gear 17' is arranged at the outlet. In ordinary state, the gear 17' is engaged with tooth 18' of the frame 1' and clamps the dragging cord 13' with wheel. If the cord 13' is dragged in left direction as shown in this figure and the gear 17' falls on a protective strip 19', the slats 11' are moved upward or downward by dragging the cord 13' or by the weight pro se of the curtain 10'.

As above description, the operation of conventional curtain requires external force, and the appearance thereof is degraded by the arrangement of the worm 15' and the cord 13'. Moreover, the provision of the cord 13' is reported to be dangerous to child. Moreover, an automatic-type curtain with motor 2' to drive one of the rope 12' and the cord 13' has been proposed, as shown in FIGS. 2 and 3. However, the appearance thereof is still degraded. A curtain with both the rope 12' and the cord 13' driven by motor 2' has also been proposed. Nevertheless, the cost is high. Moreover, as shown in FIG. 10, another conventional winding way for curtain 10 uses a motor 2' to drive the winding shaft 21 to wrap the cord 13' around the surface of the winding shaft 21. However, the cord 13' is limited by the tangent line 112 defined by the through hole 110 on a frame 1. The winding shaft 21 should have smooth surface or the effect is degraded. Therefore, the present invention is also intended to solve the problem.

Therefore, it is the object of the present invention to provide a dragging device for curtain which uses a dragging device to drag both the ladder rope and the dragging cord, thus simplifying the operation and enhancing the appearance of the curtain.

The various objects and advantages of the present invention will be more readily understood from the following detailed description when read in conjunction with the appended drawing, in which:

BRIEF DESCRIPTION OF DRAWING

FIG. 1 shows the perspective view of a conventional curtain;

FIG. 1-1 is a partial view of FIG. 1;

FIG. 1-2 is another partial view of FIG. 1;

FIG. 2 shows the perspective view of a conventional curtain;

FIG. 4-1 is the schematic view of the dragging device of the invention;

FIG. 5-1 is a view showing the operation of the invention;

FIG. 5-2 is another view showing the operation of the invention;

FIG. 5-3 is another view showing the operation of the invention;

FIG. 5-4 is another view showing the operation of the invention;

DETAIL DESCRIPTION OF THE PREFERRED EMBODIMENT

Figure 4:
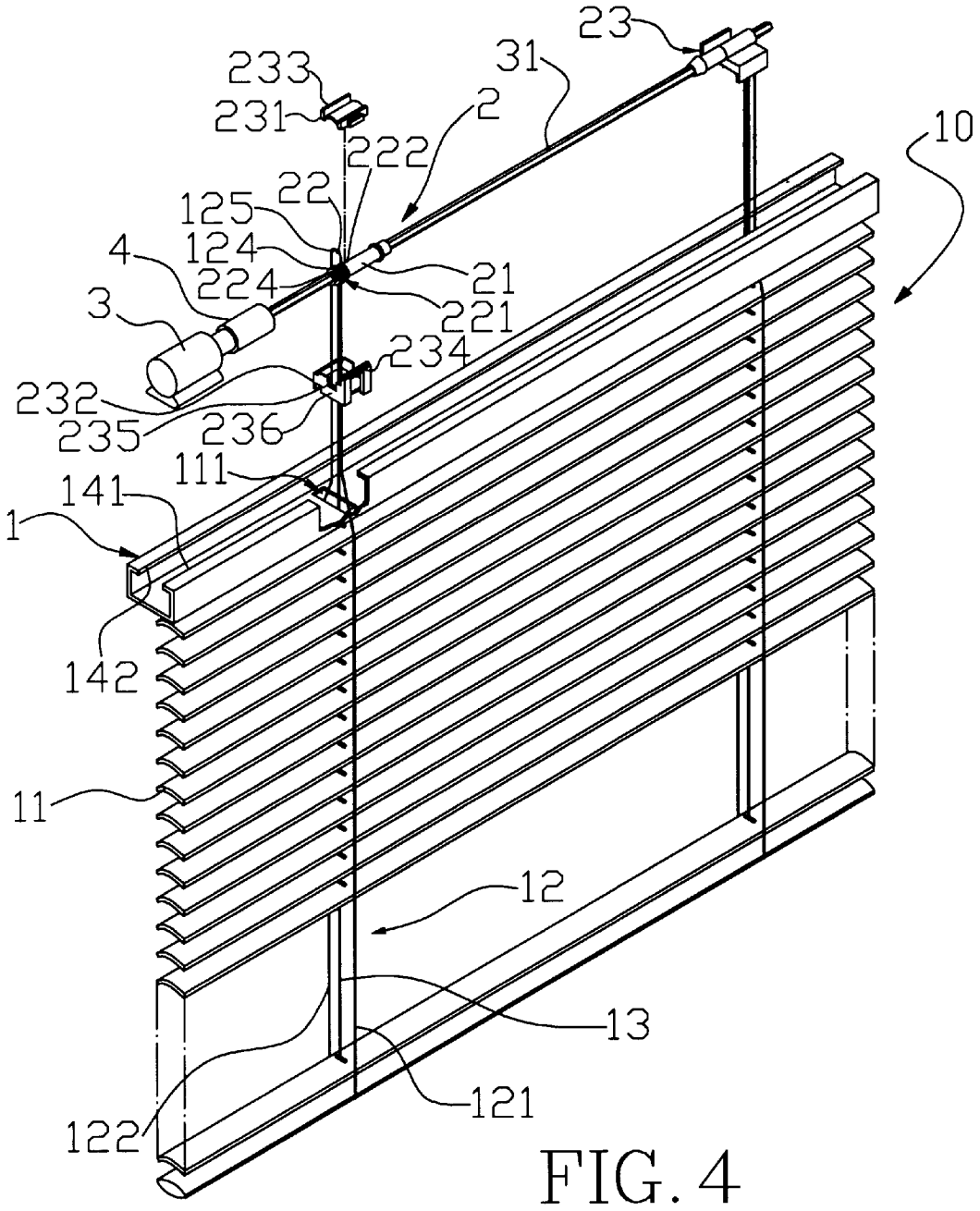
FIG. 4 shows the perspective view of the invention.

As shown in FIGS. 4 and 4-1, the inventive dragging device 2 is arranged on a hollow frame 1. A curtain 10 comprising a plurality of slats 11 is arranged below the frame 1 wherein the slats are strung by a ladder rope 12 and are parallel to each other. Through holes 111 are arranged on the slats 11 and allow the pass of the dragging cord 13. The slats can be moved upward and downward by the dragging cord 13. The rope 12 and the cord 13 are connected to the dragging device through the through hole 111.

As shown in FIG. 5-1, the ladder rope 12 comprises border lines 121, 122 and lateral lines 123, and transmission segment 124. At least one locking bump 125 is arranged on proper portion of the transmission segment 124. The locking bump 125 can be formed by the knot of the transmission segment 124 or ball tied on the transmission segment 124. By these bumps, the rope 12 is driven by the dragging device 2 to control the angle of the slats 11.

Figure 2:
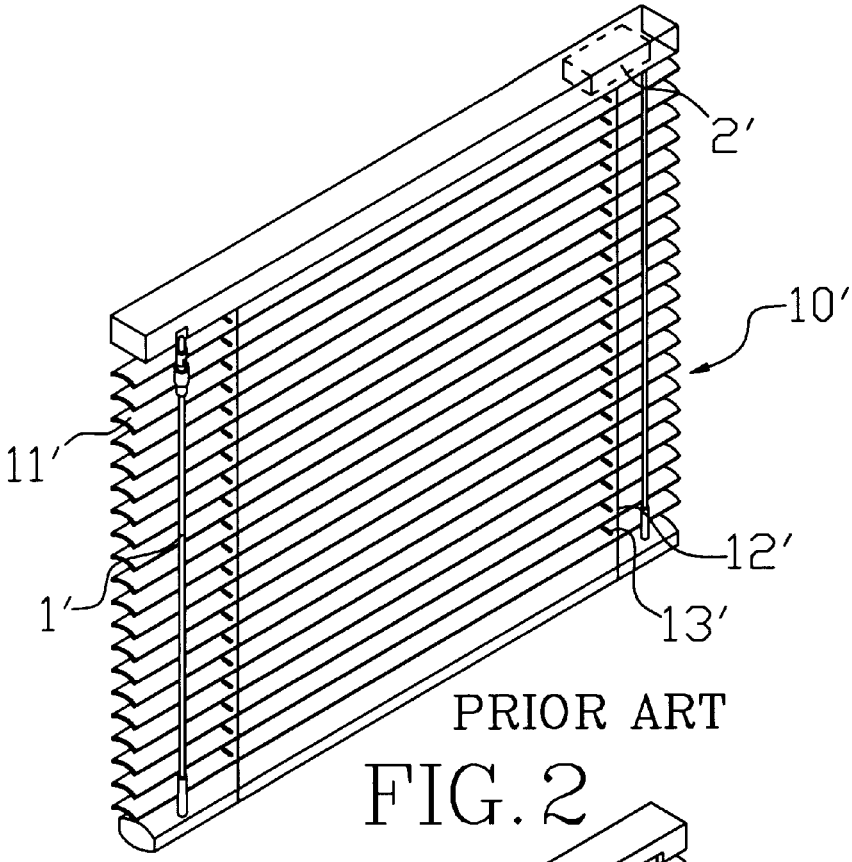
PRIOR ART FIG. 2
Figure 3:
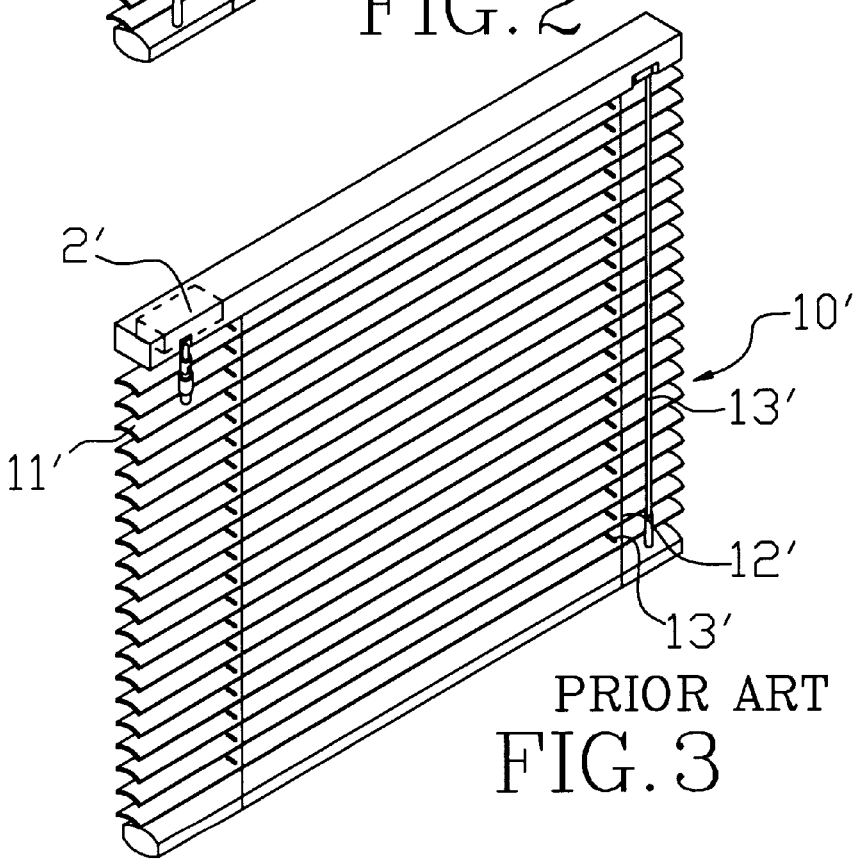
PRIOR ART FIG. 3
FIG. 3 shows the perspective view of a conventional curtain.

The dragging device 2 comprises a shaft 21 for the wrapping of the cord 13 and driven by driving shaft 31 of the driving means and a clutch means 22 for driving the rope 12 and is coaxial with the shaft 21. The clutch means 22 has at least one ring groove 221 for the coupling of the transmission segment 124, and holes 222 on the groove 201 for the embedding of the bump 125. As shown in FIGS. 5-1 and 5-2, the slats 11 can be moved upward or downward by rotating the shaft 21. Due to the friction between the transmission segment 124 and the groove 221 caused by weight of the curtain, the transmission segment 124 will be moved when the clutch means 22 is moved. Therefore, the bumps 125 are driven to be embedded into the holes 223 and rotate with the clutch means 22 or reach the another side of the transmission segment 124 relative to groove 221, thus dragging the angle of the slats 11.

From above discussion, as shown in FIG. 4, the clutch means 22 will perform an initial dragging to the slats 11, thus providing dual function for opening/closing curtain and changing the angle of the slats 11.

In practice, a locking means 4 is provided to limit the movement of the dragging device 2 when the driving means 3 is stopped. The above movement of the dragging device 2 may be caused by the weight pro se of the curtain. The locking means 4 is designed to limit the rotation of the shaft 31 when the shaft 31 is desired to be stationary.

Figure 6:
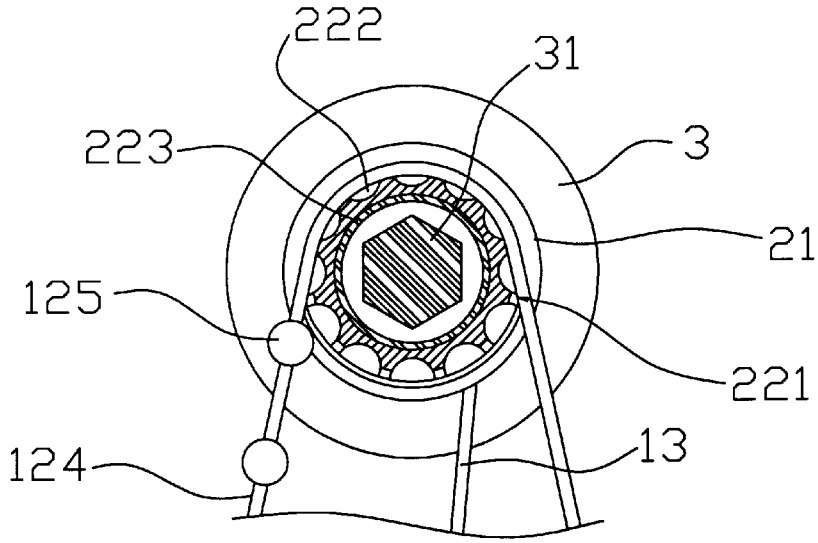
FIG. 6 is the view of the embodiment of the invention.

FIG. 6 depicts another embodiment, a magnetic member 223 is arranged on the groove 221 and the bumps 125 are made of material having attractive interaction with the magnetic member 223 to facilitate the bumps 125 to fall into the holes 221.

As shown in FIGS. 4 and 4-1, to pivotally rotate the dragging device 2, the dragging device 2 is detachably arranged on the stage 23 of the frame 1. The frame 23 comprises a cover 231 and a body 232. The cover 231 and the body 232 have clamping part 233, 234 such that the cover 231 and the body 232 are sildably arranged on the flanges 141, 142 on both sides of the frame 1. The stage 232 has hole 235 and pivoting part 224 on the location corresponding to the dragging device 2 such that the pivoting part 224 can be mounted on the hole 235 and the dragging device 2 rotates with respect to the stage 23 while being confined by the hole 235 to prevent from shaking and releasing from the frame 1. A hole 236 is provided on the body 232 for the pass of the ladder rope 12 and the cord 13 to link to the dragging device 2.

Figure 7:
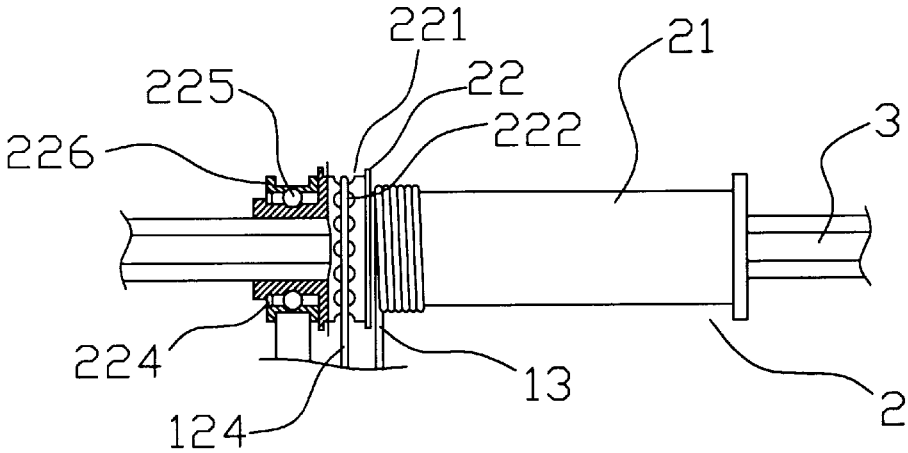
FIG. 7 is the view of another embodiment of the invention.

To reduce the frictional loss of the dragging device 2 and the hole 235, a bearing means is provided to reduce friction. The means shown in FIG. 7 comprising a plurality of beads 225 around the pivoting part 224, and a sealing lid 226 can also be used.

Figure 8:
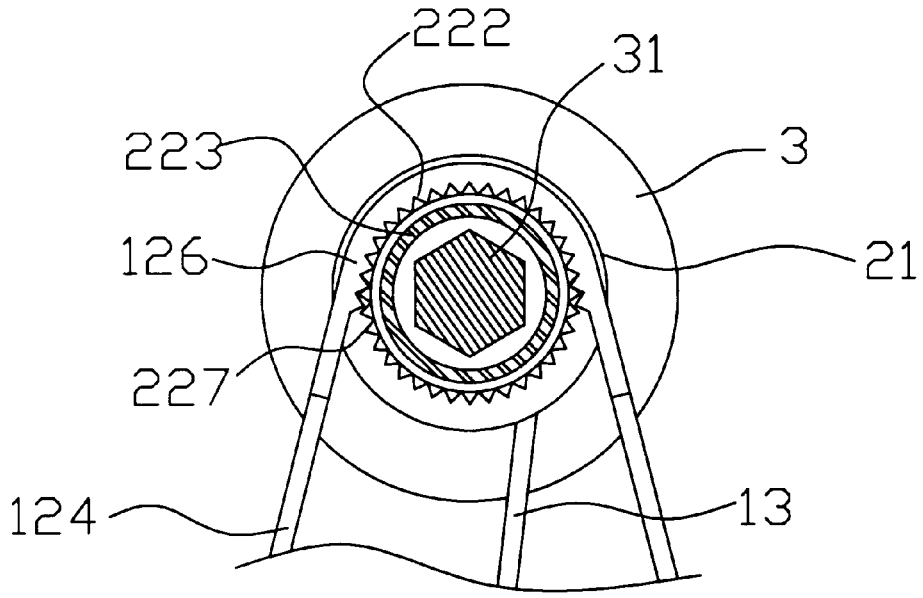
FIG. 8 is the view of another embodiment of the invention.
Figure 9:
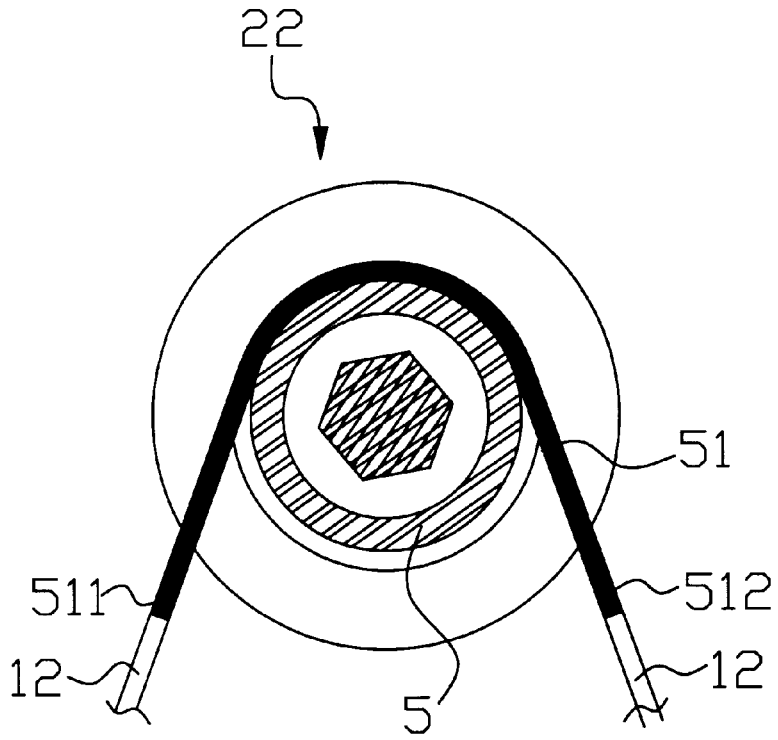
FIG. 9 is the view of another embodiment of the invention.
Figure 10:
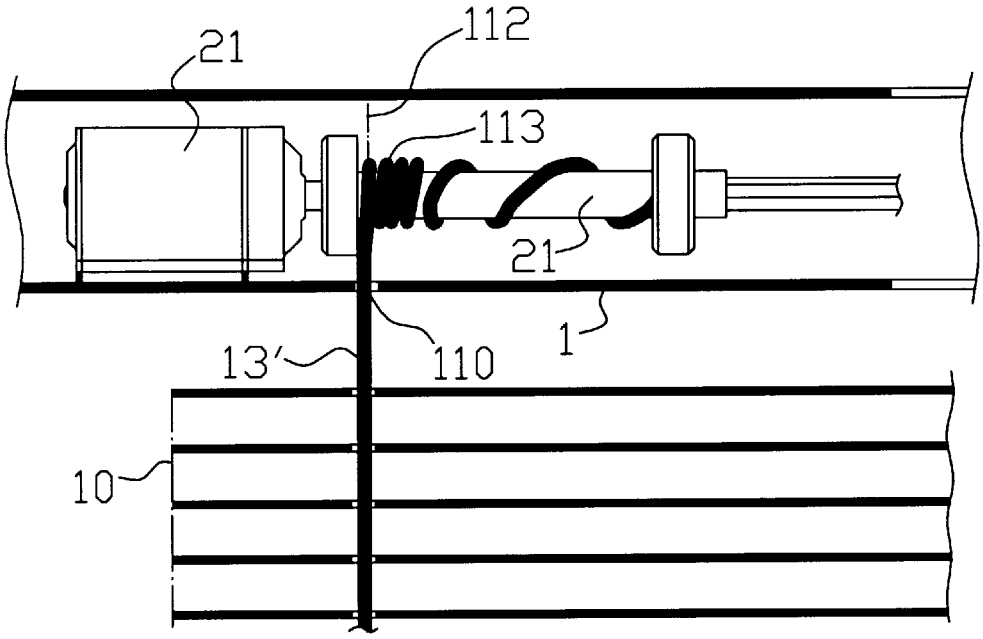
PRIOR ART FIG. 10
FIG. 10 is the view of the winding means of a conventional curtain.

As shown in FIG. 8, another embodiment of the clutch 22 and the ladder rope 12 is depicted. The clutch 22 is a gear 227 and a tooth chain 126 matched with the gear 227 is provided on the transmission segment 124. By the weight pro se of the curtain 10, the rope 12 will drive the ring groove 221. The tooth chain 126 is engaged with the gear 227 such that the angle of the drapes can be changed.

Figure 11:
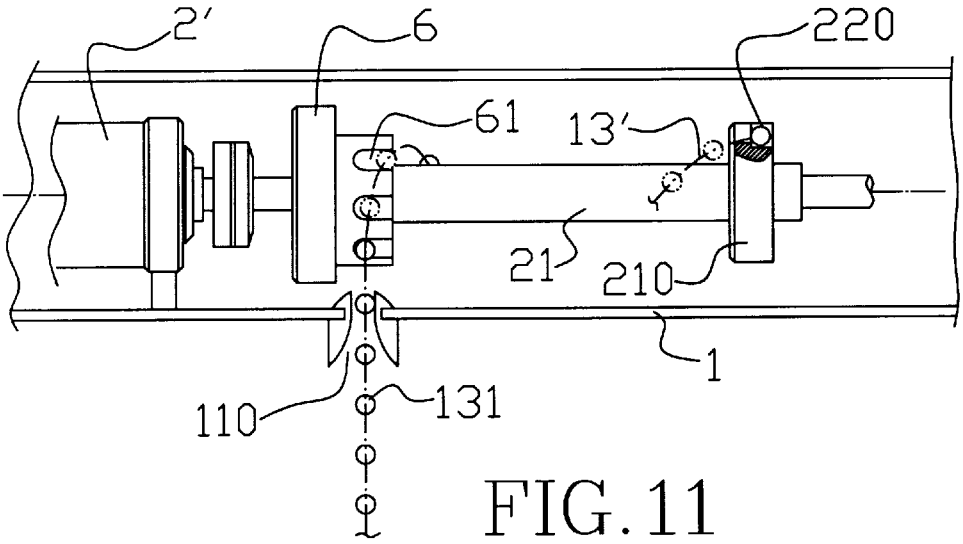
FIG. 11 is the side view of scrolling shaft of the invention.
Figure 12:
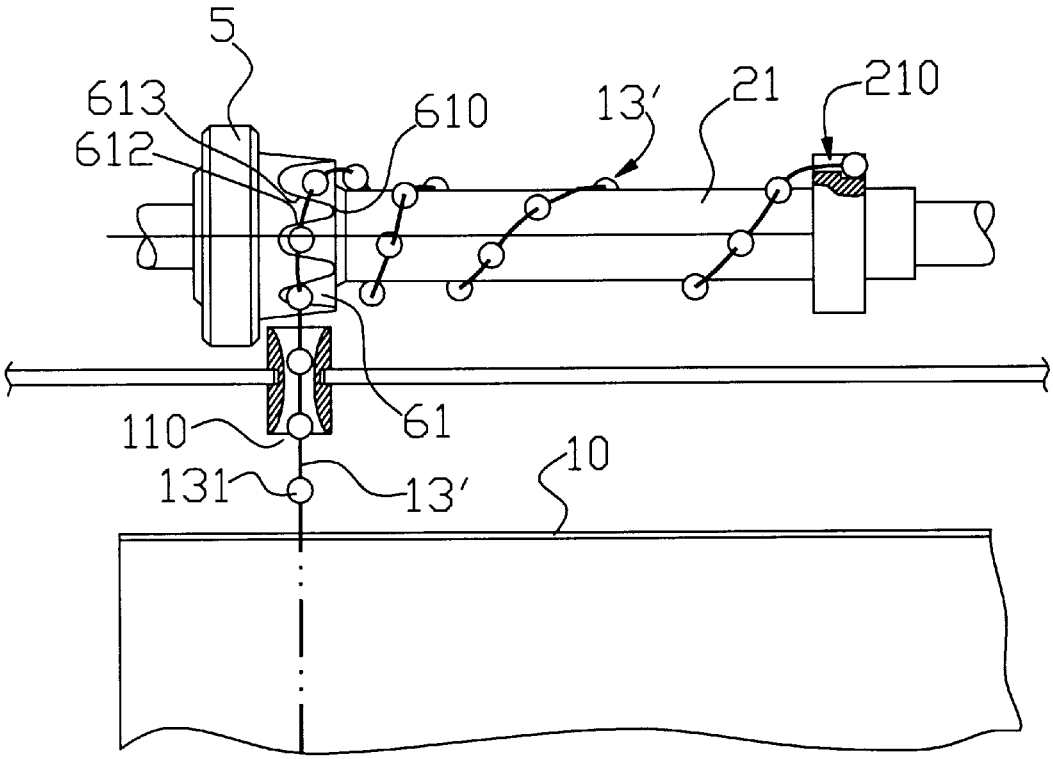
FIG. 12 shows the operation of the invention.
Figure 13:
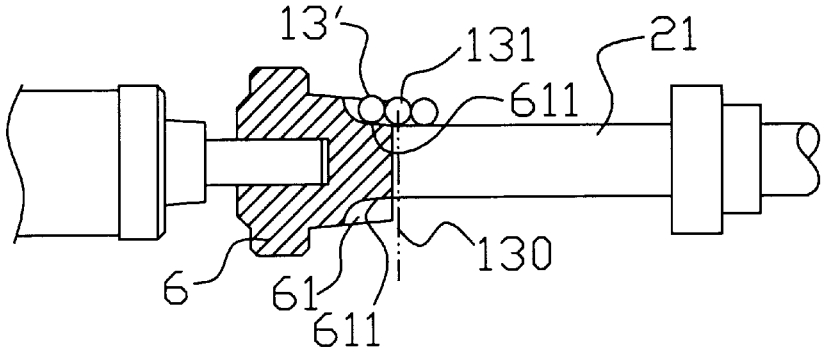
FIG. 13 is a view showing the movement of the bead in the invention.

The winding operation of the invention can also be achieved by a beaded rope, as shown in FIG. 11, a wheel 6 with grooves 61 is coaxially arranged on the shaft 21 and a stop ring 210 is at another end. Above elements are driven by a motor. The ring 210 has a lock groove 220 for locking the cord 13'. The above elements are arranged within a frame 1 which has a through hole 110 corresponding to the moving position of the cord 13'. As shown in FIG. 12, the cord 13' is provided with bead 131 connecting between the through hole 110 and the curtain 10. The bead 131 will fall into the wheel along the through hole 110 as the cord 13' is wound. The fallen bead is guided by a ramp 611, as shown in FIG. 13, to fall into the inner circle of the shaft 21. Due to the less friction between the bead 131 and the outer surface of the shaft 21, thus facilitate the winding operation. The sphere nature of the bead 131 helps the cord 13 to wrap around the shaft 21.

Figure 14:
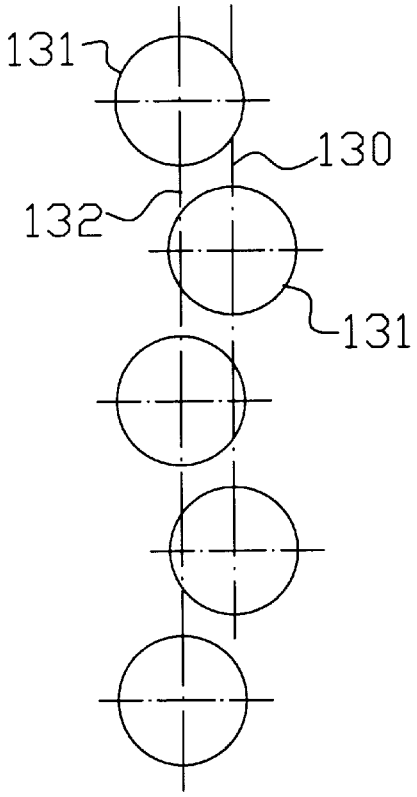
FIG. 14 is another view showing the movement of the bead in the invention.

FIG. 14 is another view showing the movement of the bead in the invention. The bead 131 of the previously wrapped circle 130 is repelled by the line 132 of the cord 13' such that the previously wrapped circle 130 is repelled further.

Figure 15:
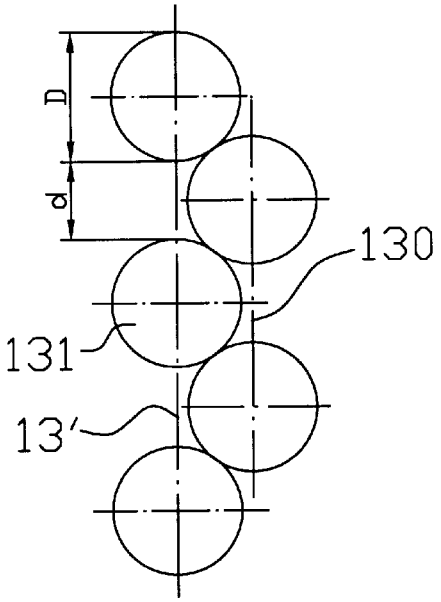
FIG. 15 is another view showing the movement of the bead in the invention.

FIG. 15 is another view showing the movement of the bead in the invention. To make advantage of the effect that the previously wrapped circle 130 is repelled by the bead 131 of the later circle and reduce the friction, the distance d between the lines is smaller than the diameter D of the bead.

Figure 16:
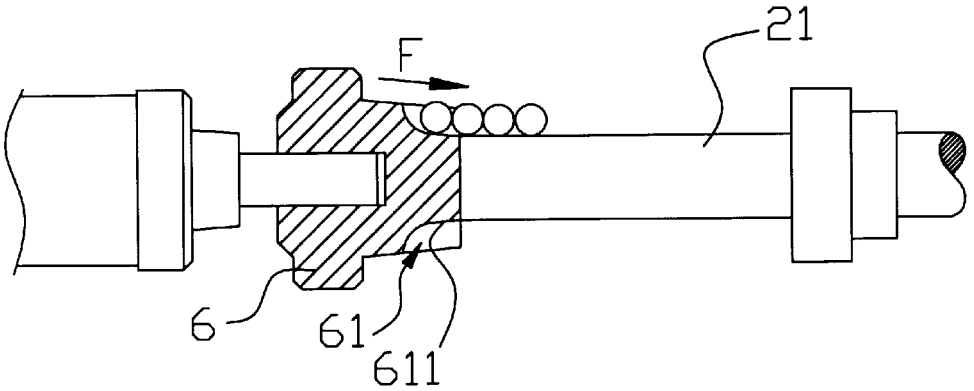
FIG. 16 is another view showing the movement of the bead in the invention.

FIG. 16 is another view showing the movement of the bead in the invention. The bottom of the ramp 611 is aligned with the outer surface of the shaft 21, the previously wrapped circle 130 is directly repelled by the force F.

FIG. 12 shows the operation of the invention. The two side surfaces 612 and 613 on both sides of the groove 61 is inclined surface and the two inclined surfaces intersects at the midpoint 610 of two adjacent grooves 61.

FIG. 13 is a view showing the movement of the bead in the invention. The wheel 6 is of cone shape and the cord 131 can be moved toward the shaft 21 by a ramp 611.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A dual function dragging device for a curtain comprising a plurality of slats arranged below a frame, said slats strung by a ladder rope and parallel to each other, said slats being able to move upward and downward by a dragging cord, said ladder rope and cord extending into said frame, said dragging device further comprising a shaft for wrapping of said cord and driven by a driving shaft of a driving means and a clutch for driving said ladder rope being coaxial with said shaft, said clutch performing an initial dragging to said slats thus providing dual function for opening/closing said curtain and changing angle of said slats, said clutch having at least one ring groove for coupling with said ladder rope, a plurality in holes of said ring groove, at least one bump on said ladder rope, said ladder rope and said ring groove having friction there between and said bumps being embedded into said holes or being released therefrom upon reaching another side of said ring groove as said clutch is rotated thus changing the angle of said slats, said bumps being larger than the diameter of said ladder rope, said clutch having a magnetic member and said balls being magnetically attracted to said magnetic member such that said balls can be urged forward and in holes received by respective ones of said, said shaft having a winding wheel with bead grooves on one axial end thereof and coaxially driven said driving means, said driving means comprising by a motor, said frame having a through hole for said cord and being aligned with said bead grooves, said cord being a beaded cord with one end arranged on another end of said winding shaft, a bottom of each bead groove being a ramp surface, two side surfaces of each bead groove being inclined surfaces, bottom exit of each bead groove being adjacent to an outer surface of said winding shaft, a length of line between two adjacent beads being smaller than a diameter of said bead, said winding wheel being of cone shape.

* * * * *